US006039219A

United States Patent [19]

Bach et al.

[11] Patent Number: 6,039,219

[45] Date of Patent: Mar. 21, 2000

[54] LIQUID DISPENSING SYSTEM FOR A REFRIGERATOR

[76] Inventors: Lanae E. Bach; Joseph Bach, both of 17460 Lakeview Dr., Morgan Hill, Calif. 95037

[21] Appl. No.: 09/008,959

[22] Filed: Jan. 20, 1998

[51] Int. Cl.[7] ..... B67D 5/62

[52] U.S. Cl. ..... 222/160; 222/146.6; 62/338; 141/362

[58] Field of Search ..... 222/146.6, 160; 62/338, 339; 141/362

[56] References Cited

U.S. PATENT DOCUMENTS

| | | | |
|---|---|---|---|
| 2,354,272 | 7/1944 | Miller et al. | 222/160 |
| 2,761,288 | 9/1956 | Anderson et al. | 222/160 |
| 2,777,304 | 1/1957 | Nave | 222/146.6 |
| 2,781,153 | 2/1957 | Roberts | 222/146.6 |
| 2,894,377 | 7/1959 | Shikles, Jr. et al. | 222/146.6 |
| 2,912,142 | 11/1959 | Schultz | 222/146.6 |
| 3,934,757 | 1/1976 | Malek et al. | 141/362 |
| 4,930,666 | 6/1990 | Rudick | 222/160 |
| 5,526,854 | 6/1996 | Unger | 141/362 |
| 5,542,265 | 8/1996 | Rutland | 222/146.6 |
| 5,683,015 | 11/1997 | Lee | 222/146.6 |
| 5,771,709 | 6/1998 | Smith | 222/146.6 |
| 5,797,519 | 8/1998 | Schroeder et al. | 222/146.6 |
| 5,813,246 | 9/1998 | Oh | 222/146.6 |

*Primary Examiner*—J. Casimer Jacyna
*Attorney, Agent, or Firm*—Joseph Bach

[57] ABSTRACT

Disclosed is a liquid dispensing apparatus implemented within a refrigerator compartment door. The system can be used to dispense any liquid, but is particularly useful for dispensing frequently consumed liquids, such as milk and juice. According to one embodiment, the system comprises refillable receptacles, while in its preferred embodiment the system is adaptable for disposable receptacles. Furthermore, in order to allow for market acceptance, an embodiment is introduces which can accommodate both refillable and disposable receptacles. According to a further embodiment, the system incorporates a rinsing feature and a predetermined liquid dispensing amount feature.

14 Claims, 3 Drawing Sheets

LIQUID DISPENSING SYSTEM FOR A REFRIGERATOR

BACKGROUND OF THE INVENTION

1. Field of the Invention

The present invention relates to refrigerators and, in particulars, to liquid dispensers situated within a refrigerator door.

2. Description of Related Art

Generally, refrigerators can be classified into three styles: freezer door on top, freezer door on bottom, and side-by-side door arrangement. The most popular model is the freezer door on top model. While the side-by-side arrangement is also desirable, it usually demands a higher price tag.

It is also known to provide ice and water dispensers within the refrigerator door. This allows dispensing of ice and water without the need for opening the refrigerator door, thus conserving energy. However, the system of water and ice delivery consumes large space and requires physical connection to the freezer compartment. Therefore, such systems can practically only be implemented within the freezer door. Since on the freezer on top model such a system would prove inconvenient since the door is too high, making it hard to reach, and since installing such a system in a freezer on bottom refrigerator would require the user to inconveniently bend down for dispensing, such systems are currently available only on the side-by-side models.

In addition to water, there are other consumables which require frequent opening of the refrigerator door, thus causing increase in energy consumption. Accordingly, recently a solution has been introduced, although it had not gained much popularity, according to which energy is conserved by implementing a door-in-door system. The idea is to make a small hatch in the refrigerator compartment door to provide access to frequently consumed items, such as milk, juice, butter etc. these systems are also currently available only on the side-by-side models.

SUMMARY OF THE INVENTION

The present invention provides an energy conserving feature which is convenient to use and can be implemented in any door configuration refrigerator. Generally, the present invention provides a liquid dispensing apparatus implemented within the refrigerator compartment door. The system can be used to dispense any liquid, but is particularly useful for dispensing frequently consumed liquids, such as milk and juice. According to one embodiment, the system comprises refillable receptacles, while in its preferred embodiment the system is adaptable for disposable receptacles. Furthermore, in order to allow for market acceptance, an embodiment is introduces which can accommodate both refillable and disposable receptacles. According to a further embodiment, the system incorporates a rinsing feature.

DETAILED DESCRIPTION OF THE PREFERRED EMBODIMENTS

As noted above, the present invention provides a liquid dispensing apparatus which, unlike the conventional ice-water dispensing system, can be easily and conveniently implemented in any refrigerator door configuration. According to certain embodiments, the system comprises refillable receptacles, while according to others it is adapted to disposable receptacles, preferably such receptacles which are currently available on the market. According to a further feature, the system includes a rinsing feature. The various features and advantages will be described hereinbelow with reference to the drawings.

Figure 1:
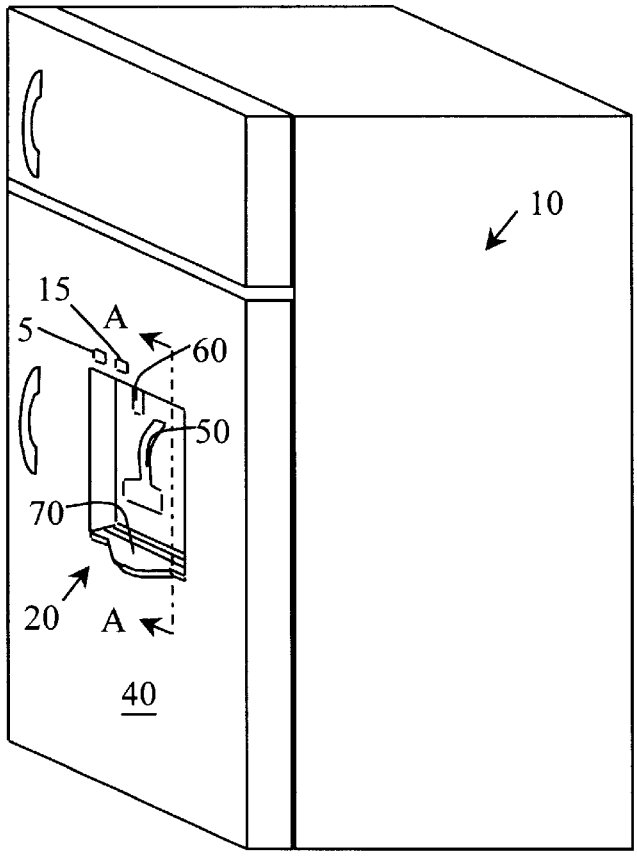
FIG. 1 is a perspective view of a freezer on top style refrigerator incorporating the liquid dispensing system according to an embodiment of the present invention.
Figure 2:
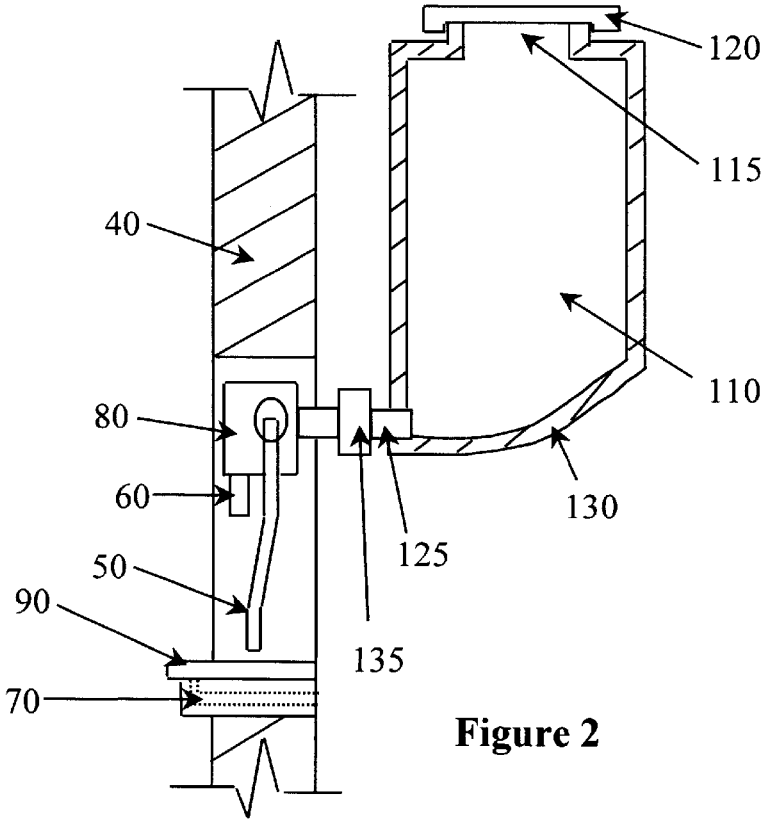
FIG. 2 is a cross section along line A—A of FIG. 1.

FIG. 1 is a perspective view of a freezer on top style refrigerator 10 incorporating the liquid dispensing system 20 according to an embodiment of the present invention. As shown in FIG. 1, the system 20 is implemented inside a cavity 30 within refrigerator compartment door 40. Also depicted in FIG. 1 are the valve lever 50, the liquid dispensing spout 60, and the overflow collection tray 70. FIG. 2 is a cross section along line A—A of FIG. 1. Shown schematically in FIG. 2 are the cut-off door 40, the spout 60, the overflow collecting tray 70, and the valve lever 50 connected to the valve assembly 80. It would be appreciated that the spout 60, the valve lever 50 and the valve assembly 80 can be any such parts currently available on the market, such as those used in the conventional water dispensing system. However, it is preferable not to use conventional overflow collecting trays.

That is, since conventional overflow collecting trays are designed to collect clear water, no special provisions are provided for cleaning. On the other hand, the present invention is designed to allow dispensing of any kind of fluids, such as milk and juice. Therefore, according to a preferred embodiment of the present invention, the overflow collecting tray incorporates a liner 90 that can be easily removed for cleaning. The liner is preferably made of a dishwasher-safe material and is simply cradled within the overflow collection tray.

Figure 3:
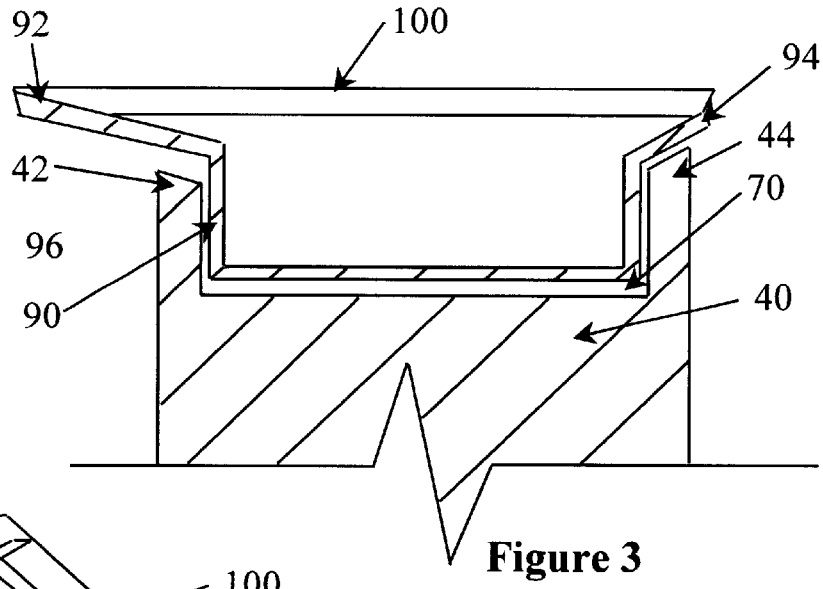
FIG. 3 is a detail cross-section view of an overflow collecting tray according to a preferred embodiment of the present invention.
Figure 4:
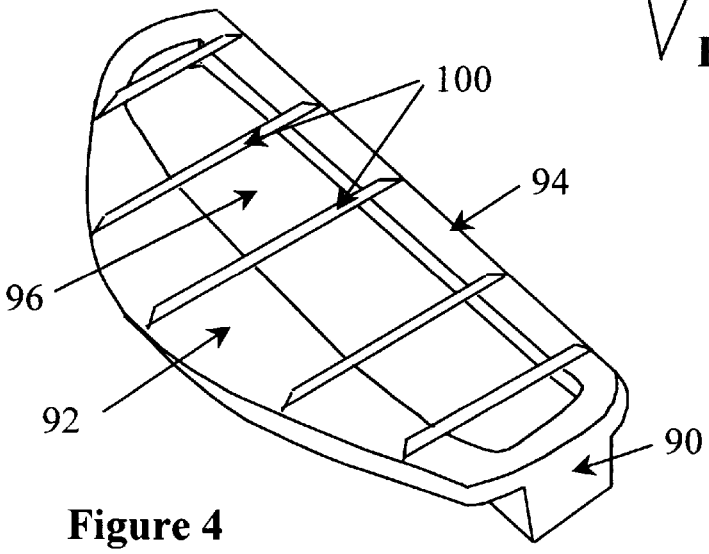
FIG. 4 is a perspective view of the overflow collecting tray according to the present invention.

FIGS. 3 and 4 depicts the removable liner 90. It includes fluid collecting bath 96, rear lip 94, front lip 92, and level grid bars 100. As shown in FIG. 3, front lip 92 stabilizes the liner 90 by resting on collecting tray front riser 42, while rear lip 94 stabilizes the liner 90 by resting on the collecting tray rear riser 44. Also, as depicted in FIG. 3, both front lip 92 and rear lip 94 are slopped to allow fluid flow into the collecting bath 96. Grid bars 100 are provided to support a cup or a bowl level. It should be appreciated that the number and design of grid bars 100 can vary so long as they keep the cup level. Preferably, the grid bard are sufficiently long to safely accommodate a cereal bowl.

Returning to FIG. 2, the dispensing system of the present invention further includes a receptacle 110 having a fill opening 115 with a cover 120. The opening 115 allows for refill of the receptacle with various fluids, such as milk and juice. A hose or pipe 125 provides fluid communication between the receptacle and the valve assembly 80 to allow dispensing of fluid from the receptacle via the spout 60. As shown in FIG. 2, the bottom of the receptacle preferably angles and has its lower most part ends at the opening to pipe 125 to allow maximum dispensing of the liquid. Not depicted in FIG. 2 are provisions to maintain the receptacle in the upright position; however, such provisions can be easily implemented and are within the grasp of those of ordinary skill in the art. It would be appreciated that, when the door is closed, the receptacle is kept within the interior of the refrigeration compartment, thus maintained refrigerated.

In its preferred embodiment, pipe 125 includes a leak-free coupling 135 to allow easy removal of the receptacle for washing and rinsing. Such leak-free coupling can be implemented using O-rings or any other known method for coupling two pipes carrying liquids. Alternatively, the coupling can be implemented inside the valve assembly. Still alternatively, the coupling can be implemented on the receptacle.

Figure 5:
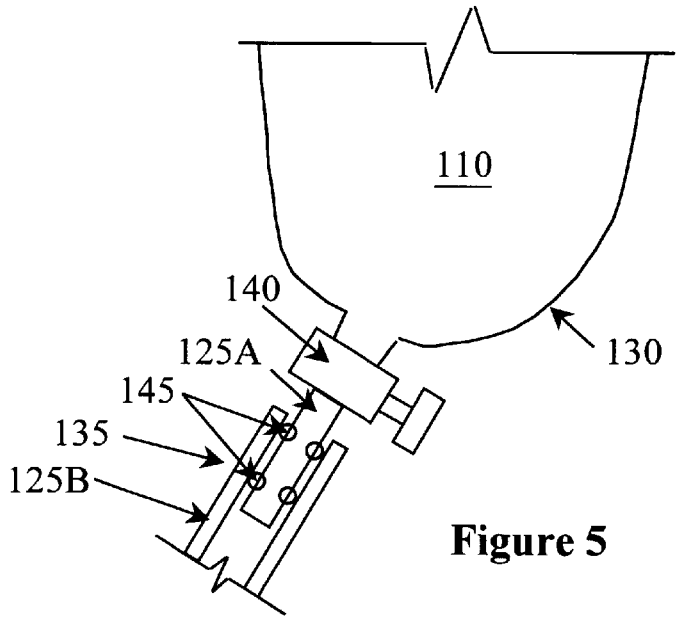
FIG. 5 is a detail view of the connection between the receptacle and the valve assembly according to an embodiment of the present invention.

FIG. 5 depicts a preferred arrangement which conveniently allows refilling the receptacle outside its resting place in the refrigerator door. In the embodiment of FIG. 5, the pipe 125 is implemented using dispensing pipe 125A on the receptacle side and receiving pipe 125B on the valve side. Receiving pipe 125B includes O-rings 145 which fit snug around dispensing pipe 125A to prevent any leaks. Additionally, dispensing pipe 125 includes a valve 140. When it is desired to refill or clean the receptacle, the valve 140 is switched to the closed position. Then, the receptacle can be removed by pulling the receptacle, thus removing pipe 125A from pipe 125B. The receptacle can then be rinsed. For reinsertion, the valve 140 closed and the receptacle can be refilled and the pipe 125A reinserted into pipe 125B. Then, the valve 140 can be switched to the open position for normal use. Of course, if valve 140 is not provided, rinsing can be done only when no liquid remains in the receptacle, and refill must be done while the receptacle is attached to the refrigerator door.

Those of ordinary skill in the art will appreciate that more than one receptacle can be provided. For example, the system can be duplicated so that both milk and juice can be dispensed. Preferable, the different liquids would be dispensed via separate valves and spouts. However, it would be appreciated that a piping arrangement can be provided to allow dispensing using a single spout, although under such conditions the valve lever should be preferably replaced by a different selection method, such as buttons connected to electrically actuated valves which are known in the art per se.

Figure 6:
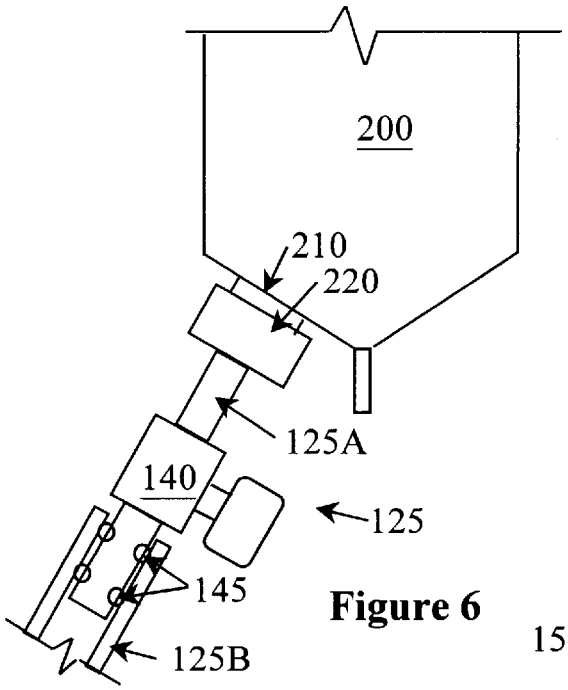
FIG. 6 is a detailed view of another embodiment of the connection between the receptacle and the valve assembly, suitable especially for use with disposable receptacles.

Reference is now made to FIG. 6, which depicts the preferred embodiment of the present invention. Generally, pipes 125A and 125B, valve 140 and O-rings 145 can be the same as those of FIG. 5. The main feature of the embodiment of FIG. 6 is that the system is adapted to accept disposable bottle 200, rather than receptacle 110. To illustrate an example, in FIG. 6 bottle 200 is such a bottle as currently used by companies like Tropicana and Minute-Made for juices. The bottle 200 includes a spout 210 having a thread and is sold with a cap (not shown). In order to place the bottle in the system of the present invention, one needs to dispose of the cap and install on threaded spout 210 the pipe 125 of the present invention, using the cap 220.

One advantageous feature of the embodiment depicted in FIG. 6 is that it could be adapted to serve both the refillable receptacle and the disposable bottle. That is, if the receptacle 110 is provided with a threaded spout similar to that of the disposable bottle, the same pipe 125 as shown in FIG. 6 can be used with either the receptacle or the bottle. Even more conveniently, the refillable receptacle 110 can be made with the same shape and dimensions as the refillable bottle, except that it would have a fill opening with a removable cover at the "conventional bottom" of the bottle. In addition to providing the user with the choice of using a receptacle or disposable bottle, such a system would allow market transition. More specifically, while the inventive system can be used with existing juice bottles, there are no known milk suppliers who sell milk in such bottles. However, if the system will become popular, then milk supplied will undoubtedly begin to sell milk in such bottles to serve a previously unavailable market segment.

Additionally, such a system can allow use of various size containers. Specifically, small families would more likely use the disposable bottles, while larger families may wish to use the refillable receptacle due to the limited size of currently available disposable bottles (the receptacle can be made at any desired, or even multiple, sizes). However, once the system becomes popular, it may create a market for larger bottles, which suppliers would likely fill.

Figure 7:
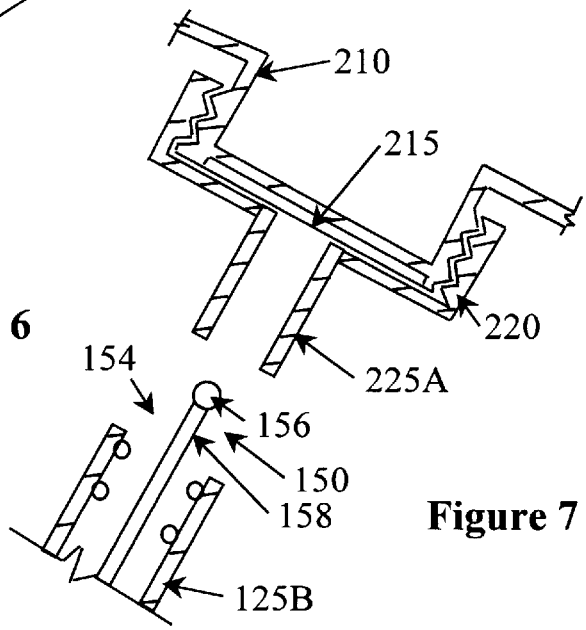
FIG. 7 is a detailed view of yet another embodiment of the connection between the receptacle and the valve assembly, suitable especially for use with disposable receptacles having a breakable seal.

A variation of the embodiment depicted in FIG. 6 is depicted in FIG. 7. According to this variation, advantage is taken of the fact that it is customary to provide a seal 215 under the cap of disposable bottles, such as those used for juice by Minute-Maid and Tropicana. This embodiment dispenses with the need for valve 140. More specifically, a needle 154 is provided which is capable of penetrating the seal 215 so as to allow fluid flow out of the bottle after penetration. Thus, the user only needs to remove the cap and attach the pipe 125 to the bottle. Upon insertion, the needle 154 would penetrate the seal 215 and allow fluid to flow into the valve assembly for dispensing. Preferably, the needle 154 has a bulk head 156 of greater diameter than the needle shaft 158. Thus, during insertion the bulk head 156 tears a hole of a larger diameter than the shaft 158 in the seal 215. When the bottle is fully inserted, the bulk head 156 passes beyond the seal and allow rapid flow of fluid from the bottle to the valve assembly. Of course, one disadvantage of such a system is that is does not allow for removal of the bottle until the bottle is completely empty. Therefore, it is preferable to retain the valve 140 even when the needle is provided.

Figure 8:
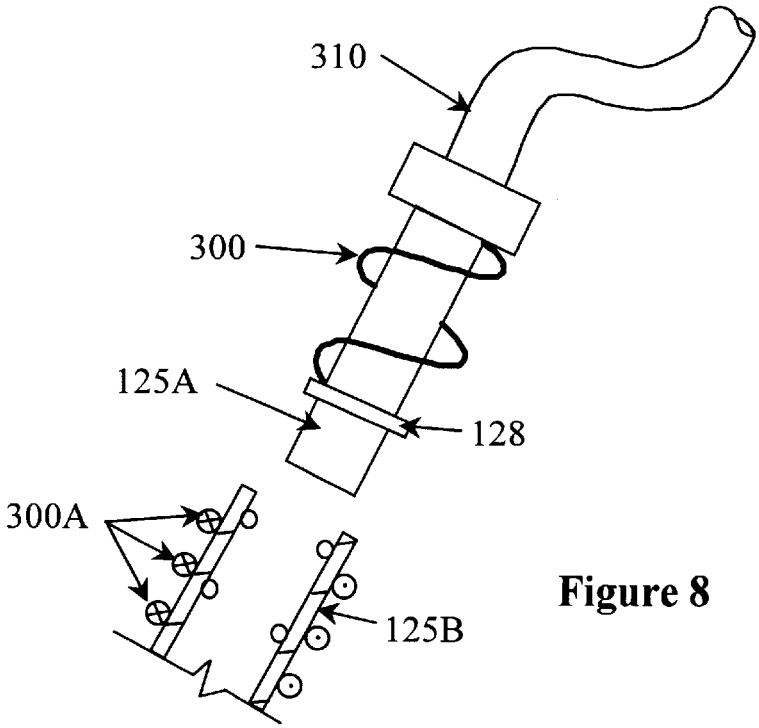
FIG. 8 is a detail view of the rinse feature of the present invention.

Another feature of the present invention is the provision for rinsing the valve assembly, including the spout. More specifically, since the present system is designed to be used with various liquids, including the ability to switch liquids each time the bottle or receptacle is emptied, it is preferable to make provisions for rinsing the valve assembly. Of course, one may flush the valve assembly by simply filling the receptacle with warm water and running the water through the valve assembly into a cup. However, for convenience, according to the preferred embodiment of the present invention, an integral rinsing system is provided, basically comprising a pipe or hose leading from the water supply, and a heating coil for heating the water just before entry into the valve assembly. Two examples of such a rinsing system are depicted in FIG. 8.

According to one embodiment, a hose 310 is provided from the water supply system. A pipe 125A similar to pipe 125 shown previously is connected at the end of the hose 310. Notably, a heating coil 300 is provided at the upper section of the pipe 125A for heating the water flowing through the pipe 125A. The pipe 125A can be inserted into the pipe 125B in a similar manner as explained above with respect to liquid dispensing. Then, the water can be turned on for flushing. Alternatively, or in addition to the coil 300, a coil 300A can be provided around the pipe 125B. Still alternatively, a water supply system can be permanently attached to the valve assembly 80, and the heating coil provided in valve assembly 80.

The present invention provides yet another feature. Specifically, it is known in conventional water-ice dispensing systems to use an electrically activated valve instead of a mechanically activated valve. In such systems, the user presses a button which electrically activates the valve to the open position for water dispensing. It should be appreciated by those of ordinary skill in the present art that such an electrically activated valve can be easily adapted to any of the embodiment above described.

However, the present invention provides a further feature which adds convenience for the user. That is, the electrically activated valve is designed such that a single pressing of the button activates the valve to the open position for a predetermined time period, so that a predetermined amount of fluid is dispensed. For example, the system can be programmed to dispense half a cup upon each depression of the button. Of course, if the user desires more than half a cup, the user can depress the button again, for another increment of half a cup. Preferably, the system is provided with the conventional momentary button 5, and with at least one additional button 15 dispensing a predetermined amount of liquid, as depicted in FIG. 1. Notably, if such a system is used, there is no need for lever 50, although it may be used for security purposes. That is, the system can be designed such that a depression of the buttons will not activate the valve unless the lever 50 is also depressed. This will avoid spillage by ensuring that no liquid is dispensed unless a cup or a bowl is provided under the spout. Moreover, the lever allows for dispensing of less liquid than the set amount. That is, if the user depresses the button for, say half a cup, but as the system starts dispensing the user decides to have only a quarter of a cup, the user then can disengage the lever and the system will stop dispensing.

A further feature of the invention which is made possible by providing both a button and a lever is a delay between dispensing. Specifically, a delay mechanism can be introduced so that a predetermined amount of time must elapse between activation of the system. Accordingly, if one depresses the button for dispensing and the system completes its delivery, the system would wait a predetermined amount of time before allowing a second dispensing, even if the button and lever are pressed. This will discourage toddlers from playing with the system. It would be appreciated that delay per se is known in the art and those of ordinary skill in the art could appreciate how to incorporate such a delay into the system.

A further feature of the present invention is the provision of a warning mechanism on the outside panel of the door, to alert the user for a low liquid level in the receptacle. Such a system can be implemented, for example, using a float in a similar manner to automobile gas tank fill level systems. Those of ordinary skill in the art will appreciate that other means for detecting the level of fluid in the receptacle can be used and, in fact, a gauge rather than a warning system can be provided.

While the present invention has been described with reference to particular embodiments and examples thereof, it would be appreciated by those of ordinary skill in the art that certain modifications and variations can be made without departing from the scope and spirit of the invention, as defined by the appended claims.

What is claimed is:

1. A liquid dispensing system for use in a household refrigerator having a refrigerator compartment door and a freezer compartment door, said compartment door configured to accept a disposable liquid receptacle, said liquid dispensing system comprising:

a dispensing bay provided on exterior side of the refrigeration compartment door;

a valve assembly attached to the refrigerator compartment door and having a dispensing spout in said dispensing bay;

an inlet situated on an interior side of the compartment door and connectable to the disposable liquid receptacle;

a rinsing system having a water delivery connection independent of said connection to the disposable liquid receptacle;

wherein said inlet is structured to receive liquid from the disposable liquid receptacle and provide the liquid to said liquid valve.

2. The liquid dispensing system of claim 1, further comprising a coupling pipe for coupling the disposable liquid receptacle to the inlet.

3. The liquid dispensing system of claim 2, wherein said coupling pipe comprises a valve allowing removal of the receptacle from the system while the receptacle still contains liquid.

4. The liquid dispensing system of claim 2, wherein said coupling pipe comprises:

a cap designed to be threaded on a spout of a commercial juice carton, a valve, and a conduit structured to form a sealed fitting with the inlet.

5. The liquid dispensing system of claim 1, wherein said valve assembly is electrically actuated, and further comprises an activation button preprogrammed to, upon depressing by a user, activate said valve assembly to the on position for dispensing a predetermined amount of liquid therethrough.

6. The liquid dispensing system of claim 1, wherein said liquid valve comprises an electrically actuated valve responsive to an on command for dispensing a predetermined amount of liquid therethrough.

7. The liquid dispensing system of claim 1, wherein said inlet comprises:

a receiving pipe; and, a seal situated inside the receiving pipe.

8. The liquid dispensing system of claim 1, further comprising an indicator provided on the exterior of the refrigeration compartment door and indicating the level of liquid in said receptacle.

9. A liquid dispensing system for use in a household refrigerator having a refrigerator compartment door and a freezer compartment door, said compartment door configured to accept an inverted disposable juice carton, said liquid dispensing system comprising:

a dispensing bay provided on exterior side of the refrigeration compartment door;

a valve assembly attached to the refrigerator compartment door and comprising:

a liquid valve;

a dispensing spout connected to the liquid valve and situated in said dispensing bay;

an inlet connectable to a coupling pipe, said coupling pipe is structured to fit on the inverted disposable juice carton; and, a water pipe connected to said valve assembly, wherein said water pipe is actuable for rinsing said valve assembly.

10. The liquid dispensing system of claim 9, further comprising a heating element for heating water received via said water pipe during the rinsing operation.

11. The liquid dispensing system of claim 9, further comprising an indicator provided on the exterior of the refrigeration compartment door and indicating the level of liquid in said receptacle.

12. A liquid dispensing system for use in a household refrigerator having a refrigerator compartment door and a freezer compartment door, said compartment door configured to accept an inverted disposable juice carton, said liquid dispensing system comprising:

a dispensing bay provided on exterior side of the refrigeration compartment door;

a valve assembly attached to the refrigerator compartment door and comprising:

a liquid valve;

a dispensing spout connected to the liquid valve and situated in said dispensing bay;

an inlet connectable to a coupling pipe, said coupling pipe is structured to fit on the inverted disposable juice carton;

a dispensing button for activating the liquid valve whenever depressed by an operator;

an activation lever connected to said valve assembly; and, wherein said liquid valve is prevented from assuming the open position unless the activation lever is depressed, thereby overriding an operator depressing the dispensing button.

13. The liquid dispensing system of claim 12, further comprising a delay mechanism introducing a minimum delay of a predetermined period between activation of said liquid valve.

14. The liquid dispensing system of claim 13, further comprising an indicator provided on the exterior of the refrigeration compartment door and indicating the level of liquid in said receptacle.

* * * * *